United States Patent [19]

Le Coent

[11] Patent Number: 4,698,170

[45] Date of Patent: Oct. 6, 1987

[54] PROCESS FOR THE PREPARATION OF VERY HIGHLY ALKALINE, CALCIUM-BASED DETERGENT-DISPERSANT ADDITIVES AND PRODUCTS PRODUCED THEREFROM

[75] Inventor: Jean-Louis Le Coent, Le Havre, France

[73] Assignee: Rhone-Poulenc Recherches, Courbevoie, France

[21] Appl. No.: 628,895

[22] Filed: Jul. 9, 1984

[30] Foreign Application Priority Data

Jul. 11, 1983 [FR] France ..... 83 11494

[51] Int. Cl.[4] ..... G10M 129/00; G10M 135/00

[52] U.S. Cl. ..... 252/33.2; 252/33; 252/33.4; 252/39; 252/40.7; 252/42.7; 252/18

[58] Field of Search ..... 252/33, 33.4, 33.2, 252/39, 40.7, 42.7, 18

[56] References Cited

U.S. PATENT DOCUMENTS

| | | | |
|---|---|---|---|
| 3,178,368 | 4/1965 | Hanneman | 252/33.4 |
| 3,256,186 | 6/1966 | Greenwald | 252/33 |
| 3,350,308 | 10/1967 | McMillen | 252/33 |
| 3,365,396 | 1/1968 | Schlicht | 252/33 |
| 3,493,516 | 2/1970 | Allphin et al. | 252/33.3 |
| 3,544,463 | 12/1970 | Koft, Jr. | 252/39 |
| 4,057,504 | 11/1977 | Shiga et al. | 252/33 |
| 4,251,379 | 2/1981 | Le Coent et al. | 252/33 |

*Primary Examiner*—William R. Dixon, Jr.
*Assistant Examiner*—Cynthia A. Prezlock
*Attorney, Agent, or Firm*—Richard M. Barnes

[57] ABSTRACT

Disclosed is a process for preparing very highly alkaline, calcium-based, detergent-dispersant additives for lubricating oils and products produced by such a process. The process includes the steps of reacting an alkylbenzenesulfonic acid, an alkylphenol, diluent oil, halogen ions and lime, removing water formed during the reaction, sulfurizing the resultant product in the presence of glycol and at least one additional alcohol having a boiling point in excess of about 155° C., carbonating the sulfurized product, removing the glycol and heavy alcohol from the sulfurized, carbonated reaction product, and filtering to remove sediment and to obtain a reaction product comprising a highly-alkaline, calcium-based detergent-dispersant additive for lubricating oils.

19 Claims, No Drawings

PROCESS FOR THE PREPARATION OF VERY HIGHLY ALKALINE, CALCIUM-BASED DETERGENT-DISPERSANT ADDITIVES AND PRODUCTS PRODUCED THEREFROM

FIELD OF THE INVENTION

The present invention relates to a process of preparing very highly alkaline, calcium-based oil additives and to the additives produced by such a process. The additives of the invention are useful for improving the detergent and dispersant properties of lubricating oils.

BACKGROUND OF THE INVENTION

Mixing additives with lubricating oils to improve the detergent-dispersant properties of such oils is known. The use of such additives has been described, for example, in European Pat. Nos. 3694, 6796, 7260 and 7257. Those patents describe processes for preparing alkylphenoxidealkylbenzenesulfonates of alkaline-earth metals which are said to have a Total Basic Number (TBN), as determined by ASTM Standard D-2896, in excess of 200 or 250. Experience has shown, however, that the processes disclosed therein do not enable the preparation of an additive having a TBN of 300 or more.

SUMMARY OF THE INVENTION

The present invention is directed to a method of preparing very highly alkaline, calcium-based detergent-dispersants by: (a) mixing an alkylbenzenesulfonic acid, an alkylphenol, diluent oil, halogen ions and lime to produce a reaction product including water; (b) removing water from the reaction product; (c) reacting the reaction product with sulfur, in the presence of glycol and at least one additional alcohol having a boiling point in excess of about 155° C. to sulfurize said product; (d) carbonating the sulfurized product; (e) removing glycol and alcohol from the carbonated sulfurized product; and (f) filtering the material obtained in step (e) to remove sediment from that material and to recover the final product.

Preferably, a $C_1$–$C_4$ carboxylic acid or a hydroxylated $C_1$–$C_4$ carboxylic acid is also mixed with the alkylbenzenesulfonic acid and the other materials in step (a) above. Examples, of such $C_1$–$C_4$ carboxylic acids and hydroxylated $C_1$–$C_4$ carboxylic acids that maybe used in this regard include formic acid, acetic acid, glycolic acid, and oxalic acid.

The additives of the present invention are preferably characterized by a TBN of at least 300 and a calcium concentration greater than about 12% by weight, more preferably, from about 12% to about 16.7% by weight. Among the advantages of the additives are that they are compatible with viscous oils and have a low sediment content and a low viscosity.

DESCRIPTION OF THE PREFERRED EMBODIMENTS

The initial step of the process of the invention comprises mixing alkylbenzenesulfonic acid, alkylphenol, diluent oil, halide ions and lime to obtain a reaction product comprising water. In the most preferred embodiments of the invention a $C_1$–$C_4$ carboxylic acid or a hydroxylated $C_1$–$C_4$ carboxylic acid is also mixed with the foregoing reagents. In addition, sulfur may be mixed with the above reagents for use in the sulfurization step described below.

Preferably, the initial step is carried out at a temperature of from about 70° C. to about 130° C. The reagents used in the initial step are preferably employed in quantities such that:

(a) the molar ratio of the alkylphenol to the alkylbenzenesulfonic acid introduced into the reaction medium is from about 0.4 to about 10 and, more preferably, the ratio is from about 0.8 to about 5;

(b) the ratio of the number of moles of lime introduced into the reaction medium to the sum of the number of moles of alkylphenol and the number of moles of alkylbenzenesulfonic acid introduced into the reaction medium is from about 2.6 to about 8 and, more preferably, the ratio is from about 2.8 to about 6;

(c) the molar ratio of the halogen ions to the lime introduced into the reaction medium is from about 0.005 to about 0.15 and, more preferably, the ratio is from about 0.015 to about 0.09; and (d) the molar ratio of the $C_1$–$C_4$ carboxylic acid or hydroxylated $C_1$–$C_4$ carboxylic acid to the lime introduced into the reaction medium is from 0 to about 0.2 and, more preferably, the ratio is from about 0.01 to about 0.2.

The duration of the initial reaction step may vary from a few minutes to about one hour. Typically, it lasts about half an hour.

As used herein, the term "alkylbenzenesulfonic acids" shall include (a) acids obtained by sulfonation of alkylbenzenes having one or a plurality of $C_{15}$–$C_{30}$ alkyl substituents derived from linear olefins or olefin oligomers, and (b) acids obtained by sulfonation of petroleum fractions. The molecular weight of said sulfonic acids (expressed as the molecular weight of their sodium salts) is generally between about 430 and about 560. The alkylbenzenesulfonic acid may be introduced into the reaction medium as an approximately 70% by weight solution of the sulfonic acid in a diluent oil.

As used herein, the term "alkylphenols" shall include alkylphenols having one or a plurality of $C_9$–$C_{15}$ alkyl substituents. The preferred alkyl phenols for use in the invention are the nonyl-, decyl-, dodecyl-decyl and tetradecylphenols.

Examples of the diluent oils useful in the present invention include the paraffin oils, such as neutral 100 oil, the naphthene oils and mixed oils. The quantity of diluent oil advantageously used is such that the amount of oil in the final product (including that initially added with the alkylbenzenesulfonic acid) is preferably from about 20% to about 60% by weight, more preferably, from about 25% to about 55% by weight and, most preferably, from about 30% to about 40% by weight of the final product.

Of the halogen ions useful in the present invention, $Cl^-$ is preferred. The halogen ions are added as ammonium or metallic salts, such as, for example, ammonium chloride, calcium chloride and zinc chloride.

The second step of the process of the invention comprises removing water formed during the initial reaction by distillation or equivalent means. This step may be carried out by heating the reaction product to a temperature of from about 110° C. to about 150° C., preferably from about 130° C. and to about 140° C. The water may be removed in a separate step or, alternatively, the water may be removed while the temperature of the reaction medium is increased for the sulfurization step described below.

The sulfurization step is carried out in the presence of glycol and an additional alcohol having a boiling point in excess of about 155° C. (hereinafter referred to as "heavy alcohol"). Examples of heavy alcohols that may be advantageously employed include: (a) the $C_6$–$C_{14}$ alkanols and cycloalkanols, such as ethylhexanol, the oxo alcohols, decyl alcohol, tridecyl alcohol and trimethylcyclohexanol; (b) the alkylene glycol ethers, such as 2-butoxyethanol, 2-butoxypropanol, 2-hexyloxyethanol and the methyl ethers of dipropylene glycol; (c) the alkylene glycols, such as propylene glycol, hexylene glycol and (d) the butanediols. All of the glycol and heavy alcohol may be added at the beginning of the sulfurization step or the glycol and heavy alcohol may be added in portions over the course of the sulfurization step.

The sulfur required for the sulfurization step of the invention may be introduced at the beginning of said step or it may be already present as a result of its having been added in the initial step as described above. The sulfurization reaction is advantageously carried out at a temperature from about 160° C. to a temperature below the boiling point of the heavy alcohol and at atmospheric pressure or under a slight vacuum. The duration of the sulfurization step is generally from about one to two hours, measured from the time that all the glycol and heavy alcohol are added.

The reagents employed in the sulfurization step of the invention are advantageously added in quantities such that:

(a) the molar ratio of the sulfur to the alkylphenol introduced into the sulfurization step is from about 0.6 to about 2 and, preferably, is from about 0.8 to about 1.5 (corresponding to a sulfur/lime molar ratio of from about 0.04 to about 0.8 and, preferably, from about 0.06 to about 0.5);

(b) the molar ratio of the glycol to the lime introduced into the sulfurization step is from about 0.03 to about 0.6 and, preferably, is from about 0.05 to about 0.4; and (c) the molar ratio of the heavy alcohol to the glycol introduced into the sulfurization step is from about 0.1 to about 30 and, preferably, is from about 0.5 to about 25.

The next step of the process is a carbonation step, which is carried out by introducing carbon dioxide into the product resulting from the sulfurization step. Preferably, the carbonation step is carried out for a period of from about one to about four hours and at a temperature of from about 160° C. to a temperature below that of the boiling point of the heavy alcohol. Typically, the duration of the carbonation reaction is about two hours.

The amount of carbon dioxide that is used in the carbonation step may vary from an amount that is completely absorbed during the carbonation step to an amount about 30% in excess of that amount. Because the carbonation reaction is exothermic, it may be desirable to add additional glycol during that reaction to compensate for any glycol that is vaporized.

After completion of the carbonation step, the glycol and heavy alcohol are removed from the carbonated product. Preferably, this is done by heating the product to a temperature of from about 180° C. to about 220° C. under vacuum for about one hour.

The product remaining after removing the glycol and heavy alcohol, as described in the preceding paragraph, contains a quantity of sediment. The sediment may be removed from the product by filtration or by any other equivalent technique to obtain, after filtration, the oil additive of the present invention.

The oil additives produced by the process of the present invention are calcium-based, have a high TBN and are characterized by their detergent-dispersant activity.

The quantity of additive that is used with a particular lubricating oil depends on the intended use of the oil. For example: (a) for a lubricating oil for a gasoline engine, the quantity of additive having a TBN of 350, employed is generally from about 1.5% to about 2% by weight of the oil; (b) for an oil for a diesel engine, the quantity of said additive used is generally from about 3% to about 4% by weight of the oil; and (c) for an oil for a marine engine, the quantity of said additive that is used generally ranges from about 7% to about 20% by weight of the oil.

A large variety of lubricating oils can be improved with the additives of the present invention. These oils include naphthene-based, paraffin-based, mixed-based lubricating oils and other hydrocarbon-based lubricants, for example, lubricating oils derived from coal products and synthetic oils such as alkylene polymers, alkylene oxide-type polymers and their derivatives, including the alkyleneoxide polymers prepared by polymerizing alkyleneoxide in the presence of water or alcohols, for example, ethyl alcohol, dicarboxylic acid esters, liquid esters of phosphoric acids, alkylbenzenes and dialkylbenzenes, polyphenyls, alkyl biphenyl ethers and silicon polymers.

Other additives may be added to the lubricating oils along with the detergent-dispersant additives of the present invention, e.g., antioxidants, anticorrosives, and ashless dispersant additives.

Examples 1, 4–10 and 13–26 below present illustrative, but nonlimiting, embodiments of this invention. Examples 2–3 and 11–12 are comparative examples.

EXAMPLES

In Examples 1–26 below, the following procedures were used, unless otherwise noted:

(A) Initial mixing reaction, removal of water and sulfurization

The following reagents were added to a stirred flask:

1. an approximately 70% by weight solution of alkylbenzenesulfonic acid having a molecular weight of approximately 480 (expressed as the molecular weight of its sodium salt) in neutral 100 oil;
2. dodecylphenol (DDP);
3. neutral 100 diluent oil;
4. acetic acid;
5. ammonium chloride or calcium chloride; and
6. lime.

The resulting reaction medium was first heated for 30 minutes at 90° C. Sulfur was added and the reaction medium heated to 155° C. under a slight vacuum ($930\times10^2$ Pa). As the temperature of the reaction was being increased to 155° C., the water formed during the initial reaction was removed by distillation. Glycol and a portion of butylglycol were then added to the heated reaction over a period of 10 minutes, after which the balance of the butylglycol was added to the heated reaction over a period of 50 minutes. The reaction temperature was then raised to 160° C. and the reaction continued for an additional hour under a slight vacuum.

(B) Carbonation

The sulfurized reaction product was heated to 165° C. and carbonated for two hours at atmospheric pressure.

(C) Removal of the glycol and butylglycol

The sulfurized, carbonated product was placed under a vacuum that was increased progressively to $66.5\times10^2$ Pa. The vacuum was maintained while the sulfurized, carbonated product was heated at 200° C. for one hour.

(D) Filtration

The sulfurized, carbonated product medium was then filtered to remove sediment.

(E) Determination Of Product Characteristics

1. Measurement of the amount of sediment

The sediment percentages were determined according to ASTM Standard D-2273-67, with the following modifications:

a. Rotational speed of the centrifuge: 6,000 rpm, b. Relative centrifugal force: 10,000;

c. The product to be analyzed was diluted with gasoline E (25 cc of product to be analyzed + 75 cc of gasoline E); and d. Duration of centrifugation: 10 minutes.

2. Compatibility test

The finished product was added to an SAE 50 oil of paraffinic tendency to obtain a solution containing 25% additive by weight. The solution was stored for 24 hours, then centrifuged under the following conditions:

a. Rotational speed: 6,000 rpm;

b. Relative centrifugal force: 10,000; and c. Duration of centrifugation: 1 hour The amount of sediment was then measured.

EXAMPLES 1 THROUGH 16

The reaction conditions for Examples 1 through 16 were as described above.

The quantities of reagents used in the different steps and the product analyses of Examples 1 through 16 are summarized in Tables I through IV.

EXAMPLE 17

The quantities of reagents used were the same as in Example 1.

(A) Initial reaction, removal of water and sulfurization

The following reagents were added to a stirred flask:

1. sulfonic acid;
2. DDP;
3. neutral 100 dilution oil;
4. acetic acid; and
5. lime The reaction mixture was heated to 90° C. and then sulfur and ammonium chloride were added and the reaction medium was heated to 155° C. under a slight vacuum ($930\times10^2$ Pa). As the temperature of the reaction was being increased to 155° C., the water formed during the initial reaction was removed by distillation. The glycol and a portion of the butylglycol were added to the heated reaction medium over a period of 20 minutes, after which the balance of the butylglycol was added to the heated reaction medium over a period of one hour. The temperature was then raised to 160° C. and the reaction continued under the same slight vacuum for two hours.

(B) Carbonation, removal of glycol and heavy alcohol and filtration

The reaction was heated to a temperature of 165° C. and then carbonated for two hours at atmospheric pressure.

The procedures for removal of the glycol and butylglycol and filtration of the product medium were identical to those described above for Examples 1-16. The properties of the resultant product were similar to those of the product of Example 1.

EXAMPLE 18

The process was carried out as described for Examples 1-16 except that 1,3-butanediol was used in place of butylglycol. The quantities of reagents used in the process steps of Example 18 and the properties of the resultant product are summarized in Table V.

EXAMPLE 19

The process was carried out as described for Examples 1-16, except that hexylglycol was used in place of butylglycol. The quantities of reagents used in the process steps of Example 19 and the properties of the resultant product are summarized in Table V.

EXAMPLE 20

The process was carried out as described for Examples 1-16, except that hexylene glycol was used in place of butylglycol. The quantities of reagents used in the process steps of Example 20 and the properties of the resultant product are summarized in Table V.

EXAMPLES 21-24

The process was carried out as described for Examples 1-16, except that 2-ethylhexanol was used in place of butylglycol. The quantities of reagents used in the process steps of Examples 21-24 and the properties of the resultant products are summarized in Table VI.

EXAMPLE 25

The process was carried out as described for Example 21, except that 13.8 g of formic acid were used in place of the 18.0 g of acetic acid. The properties of the resultant product were similar to those of the product of Example 21.

EXAMPLE 26

The process was carried out as described for Example 1, except that a mixture of 1,4-butanediol (100+193 g) and 2-ethylhexanol (100+400 g) was used in place of the butylglycol (100+560 g) and the quantity of glycol used was decreased. The quantities of reagents used in the process steps of Example 26 and the properties of the resultant product are summarized in Table VI.

TABLE I

| | | Example | | | |
|---|---|---|---|---|---|
| | | 1 | 2 | 3 | 4 |
| Sulfonic acid | g | 440 | 440 | 440 | 440 |
| Dodecylphenyol (DDP) | g | 261 | 261 | 261 | 261 |
| Oil | g | 432 | 432 | 432 | 432 |
| Acetic Acid | g | 10 | 0 | 10 | 10 |
| $NH_4Cl$ | g | 10 | 0 | 10 | 10 |
| $CaCl_2$ | g | 0 | 0 | 0 | 0 |
| Lime | g | 375 | 375 | 375 | 375 |
| S | g | 33 | 40 | 40 | 33 |
| Glycol | g | 66 | 204 | 204 | 66 |
| Butylglycol | g | 100 + 560 | 0 + 0 | 0 + 0 | 100 + 300 |
| $CO_2$ | g | 154 | 154 | 154 | 154 |
| Crude Sediment | wt. % | 1 | 6 | 5 | 1.2 |
| Analysis of the Product | | | | | |
| Ca | wt. % | 12.63 | 11.2 | 11.3 | 12.49 |
| S | wt. % | 2.74 | 3.1 | 3.1 | 2.7 |
| Viscosity (100° C.) | cst | 330 | 460 | 470 | 302 |
| $CO_2$ | wt. % | 9.6 | 8.1 | 8.2 | 9.8 |
| TBN | | 321 | 280 | 285 316 | |
| Sediments | wt. % | 0.01 | 0.1 | 0.1 | 0.02 |

TABLE I-continued

| | | Example | | | |
|---|---|---|---|---|---|
| | | 1 | 2 | 3 | 4 |
| Compatibility | wt. % sediment | traces | 1 | 1.2 | traces |

TABLE II

| | | Example | | | |
|---|---|---|---|---|---|
| | | 5 | 6 | 7 | 8 |
| Sulfonic acid | g | 440 | 440 | 440 | 440 |
| Dodecylphenyol (DDP) | g | 261 | 261 | 261 | 261 |
| Oil | g | 432 | 432 | 444 | 444 |
| Acetic Acid | g | 10 | 10 | 11.8 | 15 |
| $NH_4Cl$ | g | 10 | 10 | 0 | 15 |
| $CaCl_2$ | g | 0 | 0 | 25 | 0 |
| Lime | g | 375 | 375 | 442 | 430 |
| S | g | 33 | 40 | 33 | 33 |
| Glycol | g | 66 | 66 | 78 | 78 |
| Butylglycol | g | 100 + 160 | 100 + 560 | 100 + 525 | 100 + 525 |
| $CO_2$ | g | 154 | 154 | 195 | 187 |
| Crude Sediment | wt. % | 1.5 | 1.1 | 1.3 | 1.5 |
| Analysis of the Product | | | | | |
| Ca | wt. % | 12.2 | 12.5 | 13.85 | 13.4 |
| S | wt. % | 2.67 | 2.94 | 2.52 | 2.5 |
| Viscosity (100° C.) | cst | 246 | 412 | 371 | 363 |
| $CO_2$ | wt. % | 9.8 | 9.8 | 10.6 | 10.5 |
| TBN | | 309 | 317 | 360 | 346 |
| Sediments | wt. % | 0.03 | 0.04 | 0.06 | 0.06 |
| Compatibility | wt. % sediments | traces | traces | traces | traces |

TABLE III

| | | Example | | | |
|---|---|---|---|---|---|
| | | 9 | 10 | 11 | 12 |
| Sulfonic acid | g | 440 | 440 | 440 | 440 |
| Dodecylphenyol (DDP) | g | 261 | 261 | 261 | 261 |
| Oil | g | 432 | 432 | 432 | 432 |
| Acetic Acid | g | 15 | 20 | 0 | 10 |
| $NH_4Cl$ | g | 15 | 0 | 0 | 0 |
| $CaCl_2$ | g | 0 | 25 | 0 | 0 |
| Lime | g | 570 | 715 | 375 | 375 |
| S | g | 33 | 33 | 33 | 33 |
| Glycol | g | 90 | 107 | 66 | 66 |
| Butylglycol | g | 100 + 680 | 100 + 560 | 100 + 560 | 100 + 560 |
| $CO_2$ | g | 206 | 225 | 155 | 140 |
| Crude Sediment | wt. % | 2 | 2.5 | 7 | 6.1 |
| Analysis of the Product | | | | | |
| Ca | wt. % | 15.4 | 16.7 | 10.1 | 11.0 |
| S | wt. % | 2.35 | 2.2 | 3.1 | 3 |
| Viscosity (100° C.) | cst | 478 | 522 | 132 | 158 |
| $CO_2$ wt. % | 12 | 14.3 | 7 | 8.3 | |
| TBN | | 414 | 451 | 252 | 275 |
| Sediments | wt. % | 0.1 | 0.12 | 0.12 | 0.08 |

TABLE III-continued

| | | Example | | | |
|---|---|---|---|---|---|
| | | 9 | 10 | 11 | 12 |
| Compatibility | wt. % sediment | traces | traces | 0.1 | traces |

TABLE IV

| | | Example | | | |
|---|---|---|---|---|---|
| | | 13 | 14 | 15 | 16 |
| Sulfonic acid | g | 440 | 490 | 525 | 280 |
| Dodecylphenyol (DDP) | g | 261 | 211 | 176 | 421 |
| Oil | g | 432 | 432 | 432 | 444 |
| Acetic Acid | g | 0 | 11.8 | 11.8 | 11.8 |
| $NH_4Cl$ | g | 10 | 0 | 0 | 0 |
| $CaCl_2$ | g | 0 | 25 | 25 | 25 |
| Lime | g | 375 | 442 | 442 | 442 |
| S | g | 33 | 27 | 72 | 53 |
| Glycol | g | 78 | 78 | 78 | 78 |
| Butylglycol | g | 100 + 560 | 100 + 525 | 100 + 525 | 100 + 525 |
| $CO_2$ | g | 140 | 196 | 200 | 194 |
| Crude Sediment | wt. % | 1.6 | 1.2 | 1.2 | 1.3 |
| Analysis of the Product | | | | | |
| Ca | wt. % | 12 | 13.9 | 13.8 | 13.7 |
| S | wt. % | 2.9 | 2.5 | 0.5 | 2.5 |
| Viscosity (100° C.) | cst | 340 | 362 | 303 | 380 |
| $CO_2$ | wt. % | 8.9 | 10.5 | 10.6 | 10.5 |
| TBN | | 303 | 362 | 359 | 356 |
| Sediments | wl. | 0.1 | 0.08 | 0.1 | 0.1 |
| Compatibility | wt. % sediment | traces | traces | traces | traces |

TABLE V

| | | Example | | |
|---|---|---|---|---|
| | | 18 | 19 | 20 |
| Sulfonic acid | g | 440 | 440 | 440 |
| Dodecylphenyol (DDP) | g | 261 | 261 | 261 |
| Oil | g | 444 | 444 | 444 |
| Acetic Acid | g | 11.8 | 11.8 | 11.8 |
| $NH_4Cl$ | g | 0 | 0 | 0 |
| $CaCl_2$ | g | 25 | 25 | 25 |
| Lime | g | 442 | 442 | 442 |
| S | g | 33 | 33 | 33 |
| Glycol | g | 66 | 90 | 66 |
| Heavy Alcohol | g | 100 + 525 | 100 + 525 | 100 + 525 |
| $CO_2$ | g | 195 | 195 | 195 |
| Crude Sediment | wt. % | 1.5 | 2 | 1.5 |
| Analysis of the Product | | | | |
| Ca | wt. % | 13.8 | 13.6 | 13.8 |
| S | wt. % | 2.5 | 2.5 | 2.5 |
| Viscosity (100° C.) | cst | 410 | 365 | 340 |
| $CO_2$ | wt. % | 10.5 | 10.3 | 10.6 |
| TBN | | 359 | 357 | 360 |
| Sediments | wt. % | 0.06 | 0.05 | 0.06 |
| Compatibility | wt. % sediment | traces | traces | traces |

TABLE VI

| | | Example | | | | |
|---|---|---|---|---|---|---|
| | | 21 | 22 | 23 | 24 | 26 |
| Sulfonic acid | g | 492 | 525 | 534 | 513 | 440 |
| Dodecylphenyol (DDP) | g | 300 | 300 | 300 | 312 | 216 |
| Oil | g | 510 | 477 | 510 | 494 | 432 |
| Acetic Acid | g | 18 | 18 | 22 | 19 | 10 |
| $NH_4Cl$ | g | 0 | 0 | 0 | 0 | 10 |
| $CaCl_2$ | g | 21 | 21 | 26 | 80 | 0 |
| Lime | g | 480 | 480 | 591 | 500 | 375 |
| S | g | 42 | 42 | 42 | 43 | 33 |
| Glycol | g | 144 | 144 | 177 | 117 | 20.3 |
| Heavy Alcohol | g | 200 + 646 | 200 + 646 | 300 + 720 | 200 + 750 | 200 + 593 |
| $CO_2$ | g | 204 | 204 | 270 | 210 | 154 |

TABLE VI-continued

| | | Example | | | | |
|---|---|---|---|---|---|---|
| | | 21 | 22 | 23 | 24 | 26 |
| Crude Sediment | wt. % | 1 | 1 | 1.5 | 2 | 1 |
| Analysis of the Product | | | | | | |
| Ca | wt. % | 13.3 | 13.8 | 15 | 13.4 | 12.6 |
| S | wt. % | 2.8 | 2.7 | 2.5 | 2.7 | 3.1 |
| Viscosity (100° C.) | cst | 480 | 390 | 800 | 800 | 310 |
| $CO_2$ | wt. % | 10.75 | 10.5 | 12.7 | 9.4 | 9.7 |
| TBN | | 353 | 357 | 386 | 350 | 320 |
| Sediments | wt. % | 0.04 | 0.06 | 0.1 | 0.1 | 0.06 |
| Compatibility | wt. % sediment | traces | traces | traces | traces | traces |

What is claimed is:

1. A process of preparing detergent-dispersant additives, comprising the steps of: (a) mixing an alkyl-benzenesulfonic acid, an alkylphenol, diluent oil, halogen ions and lime to produce a reaction product including water, wherein (i) the molar ratio of the alkylphenol to the alkylbenzenesulfonic acid is from about 0.4 to about 10, (ii) the ratio of the number of moles of lime to the sum of the number of moles of the alkylphenol and the number of moles of the alkylbenzenesulfonic acid is from about 2.6 to about 8, and (iii) the molar ratio of the halogen ions to the lime is from about 0.005 to about 0.15; (b) removing water from the reaction product; (c) reacting the reaction product with sulfur in the presence of glycol and at least one additional alcohol having a boiling point in excess of about 155° C. to sulfurize said product, wherein (i) the molar ratio of the sulfur to the alkylphenol is from about 0.6 to about 2, (ii) the molar ratio of the glycol to the lime is from about 0.03 to about 0.6, and (iii) the molar ratio of the additional alcohol having a boiling point in excess of about 155° C. to the glycol is from about 0.1 to about 30; (d) carbonating the sulfurized product; (e) removing glycol and alcohol from the carbonated sulfurized product; and (f) filtering the material obtained in step (e) to remove sediment from the material and to recover the final product.

2. The process of claim 1, wherein step (a) is conducted in the presence of a $C_1$–$C_4$ carboxylic acid or a hydroxylated $C_1$–$C_4$ carboxylic acid.

3. The process of claim 2, wherein the carboxylic acid or hydroxylated carboxylic acid is selected from the group consisting of formic acid, acetic acid, glycolic acid and oxalic acid.

4. The process of claim 1, wherein the halogen ions are chloride ions.

5. The process of claim 4, wherein the chloride ions are added as ammonium chloride or metallic chloride.

6. The process of claim 1, wherein the alcohol having a boiling point in excess of about 155° C. is selected from the group consisting of the $C_6$–$C_{14}$ alkanols and cycloalkanols, the alkyleneglycol ethers, the alkylene glycols and the butanediols.

7. The process of claim 1, wherein step (a) is carried out at a temperature of from about 70° C. to about 130° C.

8. The process of claim 2, wherein the reagents are added to the reaction medium of step (a) in quantities such that: (a) the molar ratio of the alkylphenol to the alkyebenzenesulfonic acid added to the reaction medium is from about 0.8 to about 5; (b) the ratio of the number of moles of lime added to the reaction medium to the sum of the number of moles of the alkylphenol and the number of moles of the alkylbenzenesulfonic acid added to the reaction medium is from about 2.8 to about 6; (c) the molar ratio of the halogen ions to the lime added to the reaction medium is from about 0.015 to about 0.09; and (d) the molar ratio of the $C_1$–$C_4$ carboxylic acid or hydroxylated $C_1$–$C_4$ carboxylic acid to the lime added to the reaction medium is from about 0.01 to about 0.2.

9. The process of claim 1, wherein sulfur is added to the reaction medium in step (a).

10. The process of claim 1, wherein the additional alcohol has a boiling point in excess of about 160° C. and step (c) is conducted at a temperature from about 160° C. to a temperature below the boiling point of the heavy alcohol.

11. The process of claim 10, wherein sulfur is added to the reaction medium in step (c).

12. The process of claim 1, wherein: (a) the molar ratio of the sulfur to the alkylphenol added to the sulfurization step is from about 0.8 to about 1.5; (b) the molar ratio of the glycol to the lime added to the sulfurization step is from about 0.05 to about 0.4; and (c) the molar ratio of the additional alcohol having a boiling point in excess of about 155° C. to the glycol added to the sulfurization step is from about 0.5 to about 25.

13. The process of claim 1, wherein the additional alcohol has a boiling point in excess of about 160° C. and step (d) is conducted at a temperature between 160° C. and a temperature below the boiling point of the additional alcohol.

14. The process of claim 1, wherein the amount of carbon dioxide used during the carbonation step (d) is from an amount that is completely absorbed during the carbonation step to an amount about 30% in excess of that amount.

15. A detergent-dispersant additive prepared by the process of claim 1.

16. The additive of claim 15, wherein said additive is characterized by a Total Basic Number of at least about 300.

17. The detergent-dispersant additive of claim 15, wherein the calcium concentration of the additive is at least about 12% by weight.

18. A lubricating composition comprising a lubricating oil containing from about 1.5% to about 20% by weight of the detergent-dispersant of claim 15, based on the total weight of the composition.

19. A method of improving the detergent and dispersant properties of a lubricating oil, comprising adding to said oil an effective amount of the additive of claim 15.

* * * * *